US009725209B1

(12) United States Patent
Ben-Gigi

(10) Patent No.: US 9,725,209 B1
(45) Date of Patent: Aug. 8, 2017

(54) STACKABLE TOOL BOX ASSEMBLY

(71) Applicant: TEFENPLAST LTD., Tefen (IL)

(72) Inventor: Zion Ben-Gigi, Kfar Veradim (IL)

(73) Assignee: Tefenplast Ltd., Tefen (IL)

( * ) Notice: Subject to any disclaimer, the term of this patent is extended or adjusted under 35 U.S.C. 154(b) by 0 days.

(21) Appl. No.: 15/264,761

(22) Filed: Sep. 14, 2016

(51) Int. Cl.

| | |
|---|---|
| ***B65D 85/62*** | (2006.01) |
| ***B65D 21/02*** | (2006.01) |
| ***B25H 3/02*** | (2006.01) |
| ***B65D 25/28*** | (2006.01) |
| ***B65D 43/22*** | (2006.01) |
| ***B65D 43/16*** | (2006.01) |

(52) U.S. Cl.
CPC ..... *B65D 21/0228* (2013.01); *B25H 3/02* (2013.01); *B25H 3/021* (2013.01); *B65D 25/28* (2013.01); *B65D 43/16* (2013.01); *B65D 43/22* (2013.01); *B25H 3/022* (2013.01)

(58) Field of Classification Search
CPC ..... B25H 3/006; B25H 3/021; B25H 3/022; B65D 21/0228; B65D 25/28; B65D 43/16; B65D 43/22
USPC ..... 206/349, 372, 373, 503, 508, 509, 821; 220/4.27, 23.6, 23.83, 326, 810; 312/902
See application file for complete search history.

(56) References Cited

U.S. PATENT DOCUMENTS

| | | | | |
|---|---|---|---|---|
| 5,325,966 | A * | 7/1994 | Chang | B65D 21/02 206/349 |
| 6,082,539 | A * | 7/2000 | Lee | A45C 7/0045 206/1.5 |
| 7,523,827 | B2 * | 4/2009 | Dane | A61L 2/26 206/503 |
| 2003/0094392 | A1 * | 5/2003 | Meier | B25H 3/021 206/503 |
| 2007/0034539 | A1 * | 2/2007 | Henssler | A45C 13/26 206/503 |
| 2012/0024739 | A1 * | 2/2012 | Fjelland | B65D 21/023 206/503 |
| 2012/0312812 | A1 * | 12/2012 | Sosnovsky | B25H 3/021 220/23.83 |
| 2016/0008972 | A1 * | 1/2016 | Chen | B25H 3/02 206/373 |
| 2016/0144500 | A1 * | 5/2016 | Chen | B25H 3/02 206/349 |

* cited by examiner

*Primary Examiner* — Luan K Bui
(74) *Attorney, Agent, or Firm* — Dekel Patent Ltd.; David Klein

(57) ABSTRACT

A stackable tool box assembly is provided with first and second tool boxes, each of which has side latches with catches. The first and second tool boxes have a stacked orientation in which the second tool box sits on top of the first tool box, and in which the catch edge of the catch of the latch of the second tool box engages a lip of the first tool box to hold the first and second tool boxes together. The first and second tool boxes have a released orientation from the stacked orientation in which the catch edge of the catch of the latch of the second tool box is pivoted to disengage from the lip of the first tool box so that the first and second tool boxes are released from each other.

7 Claims, 2 Drawing Sheets

STACKABLE TOOL BOX ASSEMBLY

FIELD OF THE INVENTION

The present invention relates generally to tool and tool accessory boxes or cases and particularly to a stackable tool box assembly with side catches.

BACKGROUND OF THE INVENTION

Tool and tool accessory boxes (or cases, the terms being used interchangeably) are used to hold and organize all sorts of tools, such as screwdrivers, wrenches, hammers, etc., and small parts such as drill bits, fasteners, and nails. It is desirable to keep the accessories organized so that the user can easily locate the specific tool accessory for the particular purpose.

Tool accessories are commonly organized in individual compartments that are stored within the tool accessory case, and the case is secured with a latch to prevent the tool accessories from escaping the compartment. While a tool accessory case has the advantage of confining the tool accessory to the inner organizational compartment, the latch on the case may be difficult to open and close, particularly if the user is wearing work gloves or only has one hand available. Further, some latches are prone to open upon impact, such as when the case is dropped, allowing the tool accessories to escape the tool accessory case.

U.S. Pat. No. 9,193,060 to Ben-Gigi describes a tool box organizer, in which tool boxes can be stacked one on top of the other. The tool box organizer has a handle with a catch. The handle pivots so the catch locks on the bottom tool box.

SUMMARY OF THE INVENTION

The present invention seeks to provide a novel stackable tool box assembly with side catches, as is described more in detail hereinbelow.

There is thus provided in accordance with a non-limiting embodiment of the present invention a tool box assembly including first and second tool boxes. Each of the tool boxes includes a tool holding chamber with side walls, a bottom portion and a top portion. The second tool box is arranged to removably sit on top of the first tool box. For each of the tool boxes, at least one of the side walls includes a lip near the top portion. The lip has an edge that faces outwards from the at least one of the side walls. A latch is arranged to slide along the at least one of the side walls towards and away from the lip. The latch includes a catch that includes a catch edge. The catch is pivoted about a pivot so that the catch edge is movable towards and away from the at least one of the side walls. The latch is biased by a first biasing device configured to provide an urging force to urge the latch towards the top portion. The catch is biased by a second biasing device configured to provide an urging force to urge the catch edge towards the at least one of the side walls.

The first and second tool boxes have a stacked orientation in which the second tool box sits on top of the first tool box, and in which the catch edge of the catch of the latch of the second tool box is moved to overcome the urging force of the first biasing device to engage the lip of the first tool box to hold the first and second tool boxes together. The first and second tool boxes have a released orientation from the stacked orientation in which the catch edge of the catch of the latch of the second tool box is pivoted to overcome the urging force of the second biasing device to disengage from the lip of the first tool box so that the first and second tool boxes are released from each other.

In accordance with an embodiment of the present invention the at least one of the side walls includes a pair of opposite side walls.

In accordance with an embodiment of the present invention the latch is arranged to slide along the at least one of the side walls towards and away from the lip along an axis perpendicular to the bottom and top portions.

In accordance with an embodiment of the present invention the latch includes a shelf member positioned between the bottom and top portions.

In accordance with an embodiment of the present invention, in the stacked orientation, the lip of the first tool box is received in a volume bordered by the shelf member, the at least one of the side walls and the catch.

In accordance with an embodiment of the present invention the at least one of the side walls is formed with one or more wall guide members and the latch is formed with one or more latch guide members configured to move along the one or more wall guide members.

In the stacked orientation the side walls of the tool boxes may be flush with each other.

BRIEF DESCRIPTION OF THE DRAWINGS

The present invention will be understood and appreciated more fully from the following drawings:

FIGS. 4A, 4B and 4C are simplified exploded, front view and sectional illustrations of a latch of the tool box, in accordance with a non-limiting embodiment of the present invention, in which FIG. 4C is taken along lines C-C in FIG. 4B.

DETAILED DESCRIPTION OF EMBODIMENTS

Figure 1:
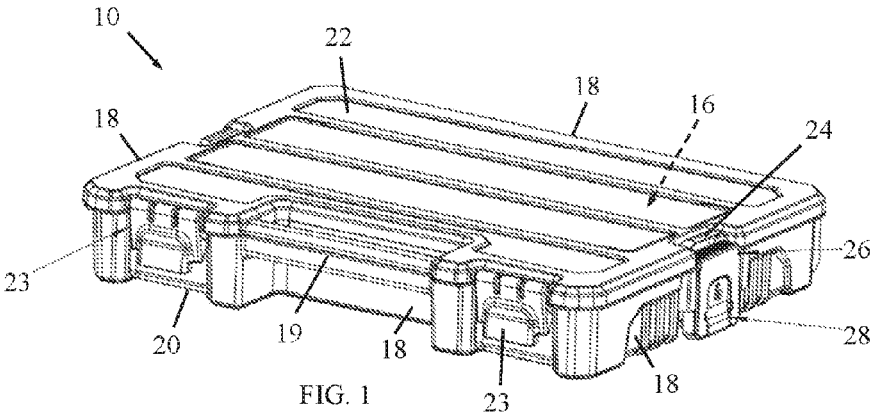
FIG. 1 is a simplified pictorial illustration of one of the tool boxes of a tool box assembly, constructed and operative in accordance with a non-limiting embodiment of the present invention.
Figure 2A:
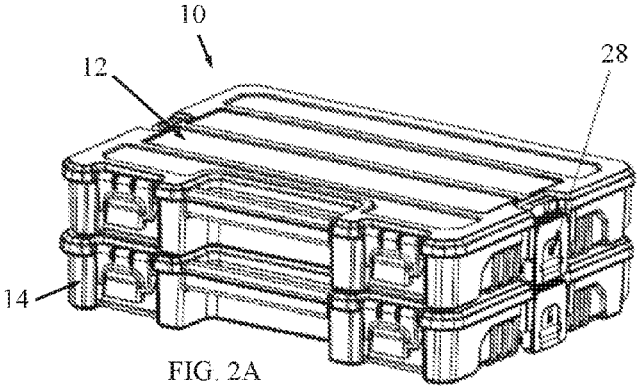
FIG. 2A is a simplified pictorial illustration of two of the tool boxes stacked one on top of the other.
Figure 2B:
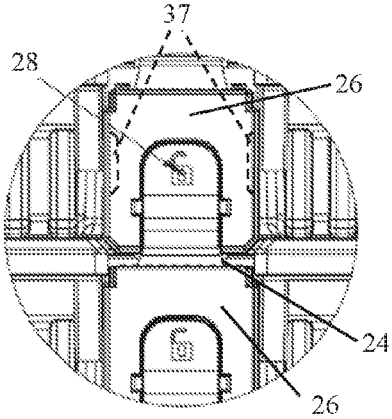
FIG. 2B is a close up view of the catch of the upper box fastened to the lower box.
Figure 3:
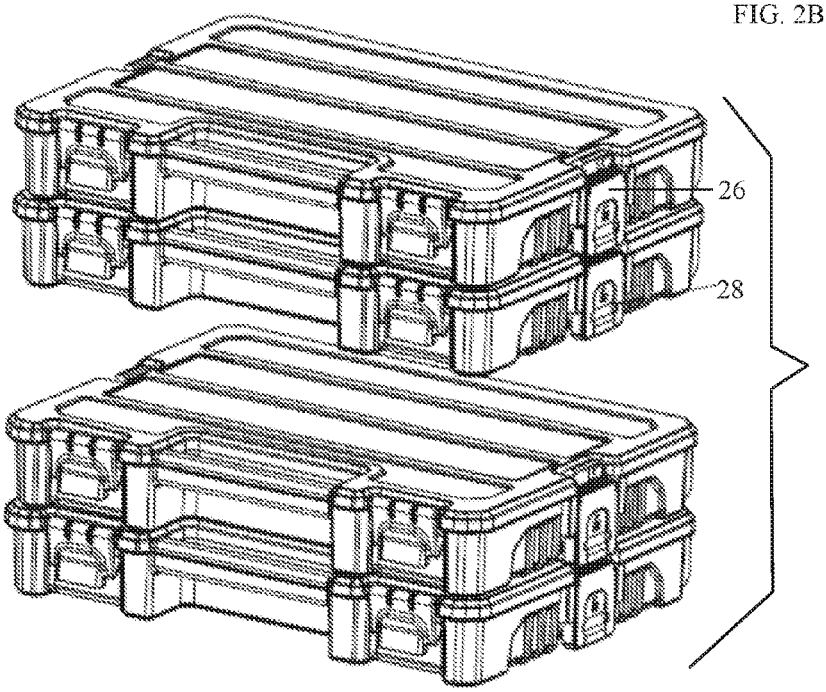
FIG. 3 is a simplified pictorial illustration of two tool boxes fastened together and released from another pair of tool boxes that are still fastened together.

Reference is now made to FIGS. 1-3, which illustrate a tool box assembly 10, constructed and operative in accordance with a non-limiting embodiment of the present invention.

The tool box assembly 10 includes first and second tool boxes 12 and 14, respectively. As shown in FIG. 1, each of the tool boxes includes a tool holding chamber 16 with side walls 18, a bottom portion 20 and a top portion 22. As shown in FIGS. 2A and 3, the second tool box 14 is arranged to removably sit on top of the first tool box 12.

The top portion 22 may be hinged to one of the side walls 18 and may be closed with one or more clasps 23 (FIG. 1). Each tool box may include a handle 19 (FIG. 1).

For each of the tool boxes, at least one of the side walls 18 includes a lip 24 near the top portion 22 (FIG. 1). As will be explained below, the lip 24 is essential is fixing the boxes to one another. Although the invention can be carried out with just one lip on one side wall (the top and bottom tool boxes may be hinged at the opposite side wall, for example), nevertheless in a preferred embodiment, the lip 24 is provided on a pair of opposite side walls such that opposing side walls get clamped together at the opposing lips 24, as described below. The lip 24 has an edge 25 (FIG. 4C) that faces outwards from side wall 18.

Figure 4A:
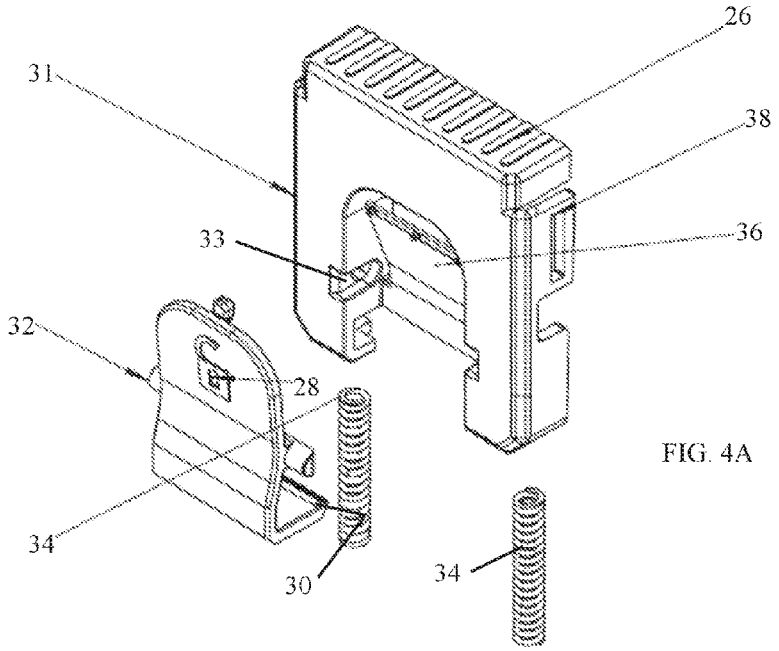
Figure 4B:
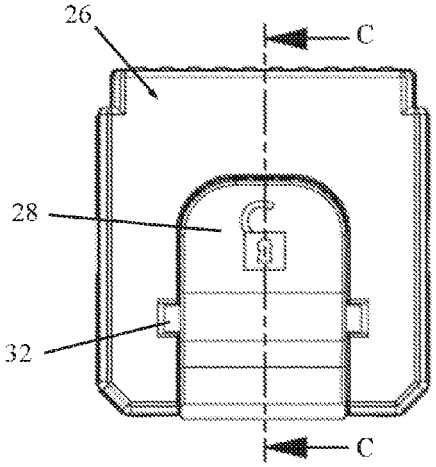

A latch 26 is arranged to slide along the side wall 18 towards and away from lip 24. Latch 26 is shown in detail in FIGS. 4A-4C. Latch 26 includes a catch 28 that includes a catch edge 30. Catch 28 is pivoted about a pivot 32 (such as, without limitation, a pin or axle, which may be integrally molded with the piece, which is received in a recess 33 formed in the latch body 31) so that catch edge 30 is movable towards and away from side wall 18. Latch 26 is biased by a first biasing device 34 (such as, without limitation, a pair of coil springs) configured to provide an urging force to urge latch 26 towards top portion 22. Catch 28 is biased by a second biasing device 36 (such as, without limitation, a leaf spring, which may be molded or otherwise formed from the same plastic as the rest of latch 26) configured to provide an urging force to urge the catch edge 30 towards side wall 18.

In accordance with an embodiment of the present invention, the side wall 18 may be formed with one or more wall guide members 37 (FIG. 2B) and latch 26 may be formed with one or more latch guide members 38 (FIG. 4A) configured to move along the wall guide members 37.

The first and second tool boxes 12 and 14 have a stacked orientation (FIG. 2A), in which the second tool box 14 sits on top of the first tool box 12. The catch edge 30 of catch 28 of latch 26 of second tool box 14 is moved (downward, in the sense of the drawings) to overcome the urging force of first biasing device 34 to engage the lip 24 of the first tool box 12 to hold the first and second tool boxes together.

The first and second tool boxes 12 and 14 have a released orientation from the stacked orientation in which catch edge 30 of catch 28 of latch 26 of second tool box 14 is pivoted to overcome the urging force of second biasing device 36 to disengage from lip 24 of first tool box 12 so that the first and second tool boxes are released from each other (FIG. 3).

Figure 4C:
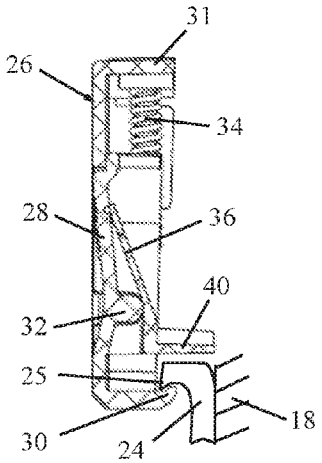

In accordance with an embodiment of the present invention, latch 26 may include a shelf member 40 (FIG. 4C) positioned between the bottom and top portions. Shelf member 40 may be parallel to the top surface of latch 26. In FIG. 4C, it is noted that in the stacked orientation, lip 24 of the first tool box is received in a volume bordered by the shelf member 40, side wall 18 and catch 28.

As seen in FIGS. 2A and 3, in the stacked orientation, side walls 18 of the tool boxes may be flush with each other. Alternatively, the boxes may be sized and shaped so the side walls 18 are not flush with each other.

What is claimed is:

1. A tool box assembly comprising:

first and second tool boxes, each of said tool boxes comprising a tool holding chamber with side walls, a bottom portion and a top portion, said second tool box arranged to removably sit on top of said first tool box; and wherein for each of said tool boxes, at least one of said side walls comprises a lip near said top portion, said lip having an edge that faces outwards from said at least one of said side walls, and a latch arranged to slide along said at least one of said side walls towards and away from said lip, said latch comprising a catch that comprises a catch edge, said catch being pivoted about a pivot so that said catch edge is movable towards and away from said at least one of said side walls, said latch being biased by a first biasing device configured to provide an urging force to urge said latch towards said top portion and said catch being biased by a second biasing device configured to provide an urging force to urge said catch edge towards said at least one of said side walls, wherein said first and second tool boxes have a stacked orientation in which said second tool box sits on top of said first tool box, and in which said catch edge of said catch of said latch of said second tool box is moved to overcome the urging force of said first biasing device to engage said lip of said first tool box to hold said first and second tool boxes together;

and wherein said first and second tool boxes have a released orientation from said stacked orientation in which said catch edge of said catch of said latch of said second tool box is pivoted to overcome the urging force of said second biasing device to disengage from said lip of said first tool box so that said first and second tool boxes are released from each other.

2. The tool box assembly according to claim 1, wherein said at least one of said side walls comprises a pair of opposite side walls.

3. The tool box assembly according to claim 1, wherein said latch is arranged to slide along said at least one of said side walls towards and away from said lip along an axis perpendicular to said bottom and top portions.

4. The tool box assembly according to claim 1, wherein said latch comprises a shelf member positioned between said bottom and top portions.

5. The tool box assembly according to claim 4, wherein in the stacked orientation, said lip of said first tool box is received in a volume bordered by said shelf member, said at least one of said side walls and said catch.

6. The tool box assembly according to claim 1, wherein said at least one of said side walls is formed with one or more wall guide members and said latch is formed with one or more latch guide members configured to move along said one or more wall guide members.

7. The tool box assembly according to claim 1, wherein in the stacked orientation the side walls of said tool boxes are flush with each other.

* * * * *